US005572926A

United States Patent [19]

Bachhuber

[11] Patent Number: 5,572,926

[45] Date of Patent: Nov. 12, 1996

[54] PRESS UNLOADER FOR UNLOADING PRESSES

[76] Inventor: Peter Bachhuber, 368 Park St., Mayville, Wis. 53050

[21] Appl. No.: 375,444

[22] Filed: Jan. 19, 1995

[51] Int. Cl.[6] ..... B30B 15/32

[52] U.S. Cl. ..... 100/35; 72/426; 83/82; 83/157; 83/165; 100/218

[58] Field of Search ..... 100/35, 218; 72/426, 72/427; 83/82, 157, 165

[56] References Cited

U.S. PATENT DOCUMENTS

| | | | |
|---|---|---|---|
| 2,693,159 | 11/1954 | Taylor | 100/218 |
| 3,148,571 | 9/1964 | Wallis | 83/82 |
| 3,349,602 | 10/1967 | Nelson | 72/426 |
| 3,653,293 | 4/1972 | Wallis | 83/82 |
| 3,756,107 | 9/1973 | Pax et al. | 83/165 |
| 3,889,563 | 6/1975 | Westermann | 83/157 |
| 3,893,358 | 7/1975 | Dixon | 83/82 |
| 3,948,129 | 4/1976 | Plegat | 83/157 |
| 4,068,519 | 1/1978 | Baringer | 72/426 |
| 4,078,461 | 3/1978 | Ohta | 83/157 |
| 4,242,900 | 1/1981 | Dixon | 83/82 |
| 4,961,337 | 10/1990 | Henning et al. | 72/426 |
| 5,245,900 | 9/1993 | Dojnik | 83/165 |

FOREIGN PATENT DOCUMENTS

| | | | |
|---|---|---|---|
| 72621 | 4/1960 | France | 100/218 |
| 266318 | 3/1989 | Germany | 100/218 |
| 60-64742 | 4/1985 | Japan | 100/218 |
| 62-89537 | 4/1987 | Japan | 72/426 |
| 564060 | 7/1977 | U.S.S.R. | 100/218 |
| 1039617 | 9/1983 | U.S.S.R. | 72/426 |
| 1632587 | 3/1991 | U.S.S.R. | 72/426 |

*Primary Examiner*—Stephen F. Gerrity
*Attorney, Agent, or Firm*—Wheeler Kromholz & Manion

[57] ABSTRACT

An apparatus and method for unloading presses with a nonhydraulic press unloader. The apparatus generally includes a support frame, a reciprocating tray, a tray arm, a link arm, an actuating arm, and an attachment arm. The support frame has a pair of support frame members having top surfaces. A tray roller, for supporting the reciprocating tray, is rotatably mounted to each end of the support frame member. The tray arm is slidably engaged with the top surface of one of the support frame members and is pivotally attached to the link arm. The midsection of the tray arm is pinably connected to the reciprocating tray. The actuating arm is pivotally connected to the other end of the link arm and to the support frame. A pickup roller is rotatably attached to the actuating arm near its midsection. A release roller is rotatably attached to the actuating arm also near the midsection and adjacent the pickup roller. As the press ram rises, the arms draw the tray in between the gap presented by the separating die halves. The workpieces are dropped onto the tray. Just prior to the ram reaching top dead center, the tray is released and retracts under the force of gravity. The mechanism is then reset for the next ram stroke.

9 Claims, 4 Drawing Sheets

PRESS UNLOADER FOR UNLOADING PRESSES

BACKGROUND OF THE INVENTION

Hydraulic presses are commonly used in industry for the manufacture of machine parts. Dies mounted in hydraulic presses are often used to form machine parts from sheet metal or to trim flash from die cast machine parts. These presses have three main components including a base, a ram and a mechanism for moving the ram. The die is the cutting or forming tool which is mounted within the press. Typically, these presses have dies that are capable of forming or trimming one (1) to twenty-four (24) pieces at a time.

A die has two halves; the upper half is mounted to the ram and the lower half is mounted to the base. When the ram rises, the die is separated and the surfaces which perform the forming or trimming operation are exposed. The workpiece is placed in the opening presented between the die halves. When the ram drops, the die halves come together and perform their intended function. When the die halves separate, the machine parts or workpieces are commonly held to the top half of the die. When the top die half reaches the top of the press stroke, ejection pins release the workpieces from the top die half.

The workpieces must be removed from between the die halves. Currently, the only inexpensive method of removing these pieces from the press is by hand. There are hydraulic removal systems available on the market, but they are extremely expensive. The present invention by means of its unique simple design provides an inexpensive and efficient method and structure for automatically removing the workpieces from the press.

It is an object of this invention to provide a non-hydraulic press unloader for unloading workpieces from a press that is fully adjustable with respect to height and angle positions, movable and adaptable to any press, easy to use, provides safe operation, and is cost effective. The press unloader requires no separate power sources or timing mechanisms. It easily attaches, either permanently or removably, to virtually any press and utilizes the press ram for all motion as well as timing.

SUMMARY OF THE INVENTION

The present invention is an apparatus and method for unloading trim and forming presses with a nonhydraulic press unloader. The apparatus generally includes a support frame, a reciprocating tray, a tray arm having a first end, a second end, and a midsection, a link arm having a first end, a second end, and a midsection, an actuating arm having a first end, a second end, and a midsection, and an attachment arm having a first end, a second end, and a midsection. The support frame has a pair of support frame members having top surfaces and ends. A tray is roller rotatably mounted to each end of the support frame members and each tray roller supports the reciprocating tray. The first end of the tray arm is slidably engaged with the top surface of one of the support frame members, the second end of the tray arm is pivotally attached to the first end of the link arm, and the midsection of the tray arm is pinably connected to the reciprocating tray. The first end of the actuating arm is pivotally connected to the second end of the link arm and the second end of the actuating arm is pivotally connected to the support frame. A pickup roller is rotatably attached to the actuating arm near the midsection. A release roller is rotatably attached to the actuating arm near the midsection and adjacent the pickup roller. The first end of the attachment arm is pivotally connected to the support frame and the second end of the attachment arm is connected to the press ram. A pickup notch is formed in the mid section of the attachment arm for receiving and the releasing the pickup roller.

The invention also comprises a method for unloading workpieces from a press having a ram mechanism capable of moving in a predetermined manner using an apparatus including an attachment linkage extending substantially from a support structure to the ram mechanism and including an engagement structure, a linkage mechanism having a bearing surface engaged with a portion of the support structure, a substantially fixed connection to a workpiece receiving structure, a beating structure capable of both engaging and disengaging the engagement structure, and a lever mechanism, the lever mechanism being connected to the linkage mechanism and extending substantially from a portion of the linkage mechanism to a portion of the attachment linkage, the method comprising the steps of moving the ram so that the engagement structure engages the bearing structure of the linkage mechanism so that the workpiece receiving structure is moved a predetermined distance, in a predetermined direction, into the press, disengaging the bearing structure from the engagement structure with the lever mechanism after the workpiece receiving structure has moved the predetermined distance, in the predetermined direction into the press, and sliding the workpiece receiving structure away from the press on the bearing surface engaged with the portion of the support structure.

DETAILED DESCRIPTION

Figure 1:
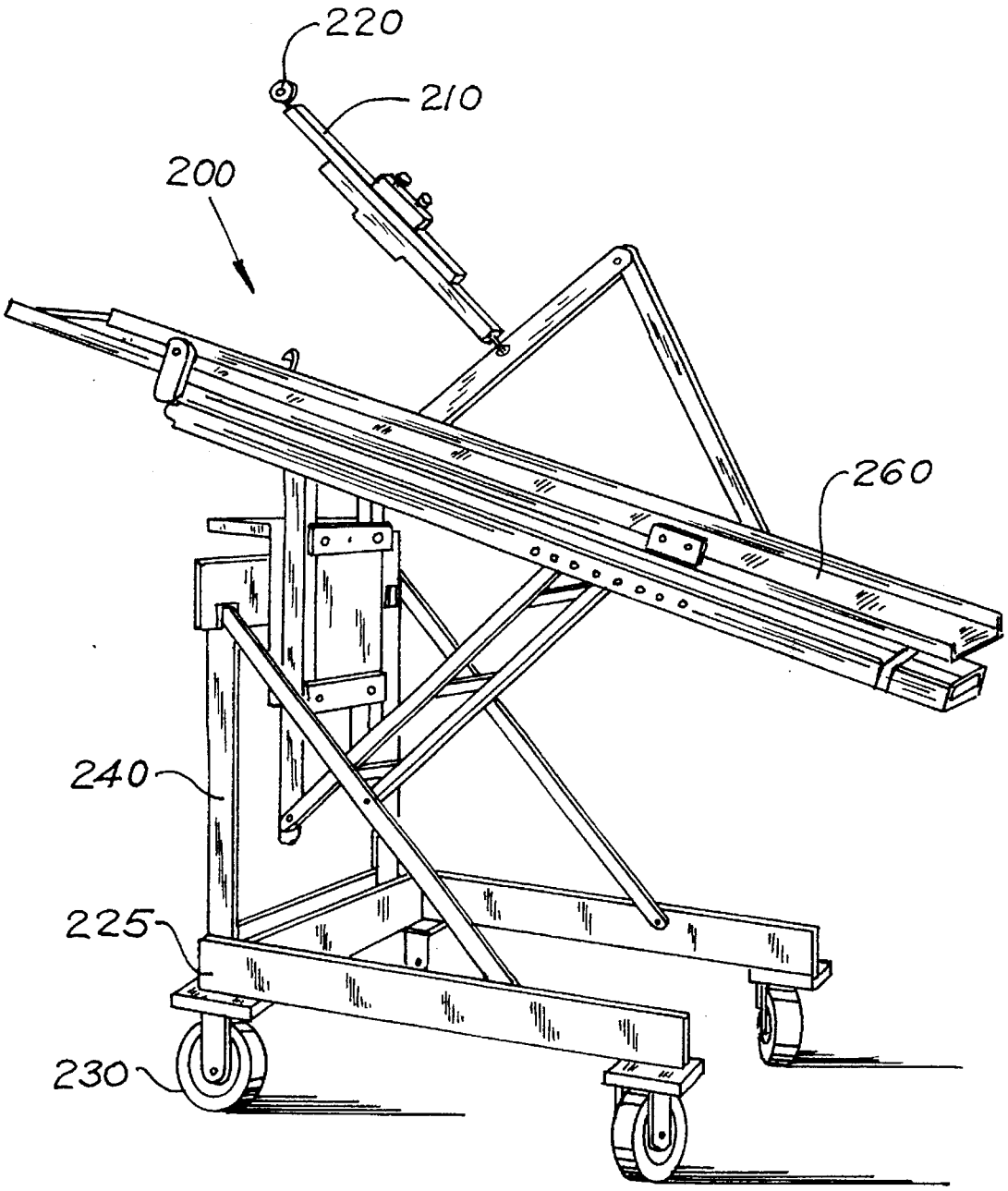
FIG. 1 PRIOR ART
FIG. 1 is a perspective view of a prior art press unloader.

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

The invention, referred to herein and shown at 10 in the drawings, comprises a non-hydraulic press unloader for unloading presses. It includes the following components: a support frame 20, a reciprocating tray 40, a tray arm 60, a link arm 80, an actuating arm 100, and an attachment arm 120.

A prior art press unloader 200 is shown in FIG. 1. This press unloader 200 has a solid attachment arm 210 including a connector 220 for connecting the attachment arm 210 to the ram 310 of the press 300. This type of press unloader 200 is well known in the art. The press unloader 200 further includes a support frame 240 and support base 225 to which four (4) wheels 230 are attached to provide easy mobility. The support frame 240 has many other structural components, all of which are well known in the art, for adjusting the height, location, position, and stroke of the press unloader 200 and the press unloader tray 260.

Figure 2:
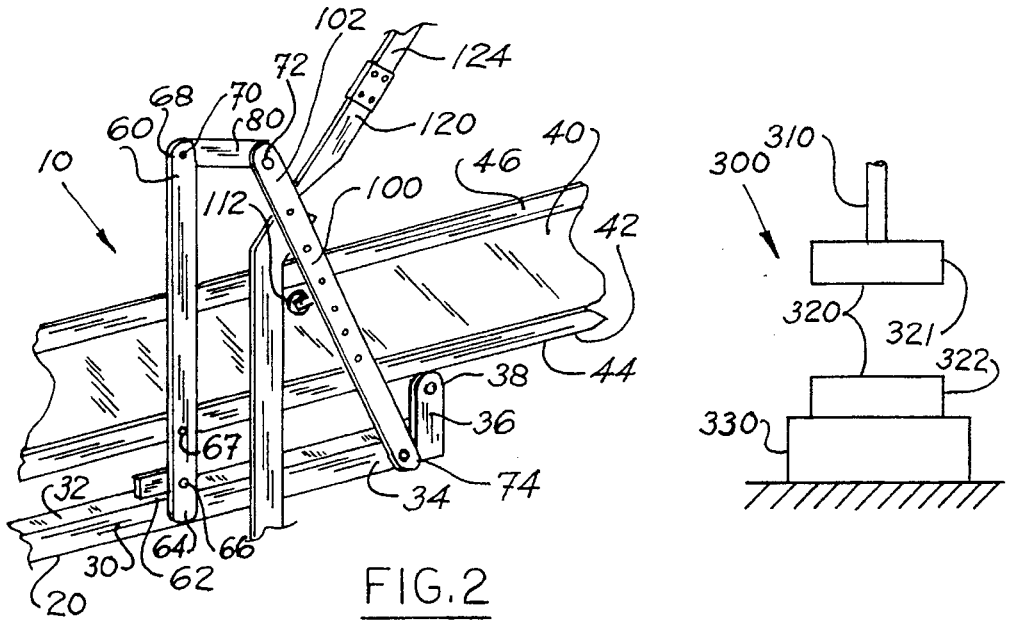
FIG. 2 is a partial perspective view of the unloader mechanism of the present invention in the extended position.

A hydraulic press 300 is shown in FIG. 2. It comprises a press base 330 to which the lower half 322 of die 320 is mounted and a press ram 310 to which the top or upper half 321 of die 320 is mounted.

Figure 3:
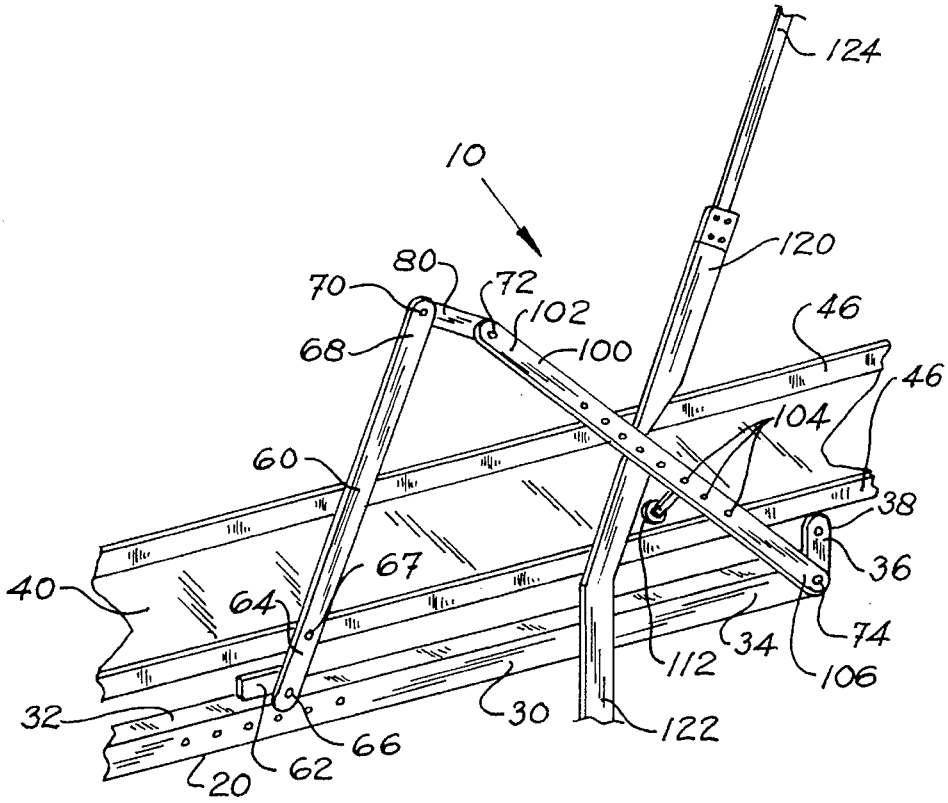
FIG. 3 is a partial perspective view of the unloader mechanism of the present invention in the retracted position.

Referring to FIGS. 2 and 3, the unloading mechanism of the present invention 10 utilizes a similar support frame, shown at 20, and tray, shown at 40. The frame 20 of the present invention includes a pair of support members 30, each support member 30 having a flat top surface 32 and an end 34. At each end 34, a tray roller support bracket 36 is attached to which a tray support roller 38 is rotatably mounted. The reciprocating tray 40 is partially supported by the pair of rollers 38. The rollers 38 are in constant contact with the underside 42 of the tray 40. The reciprocating tray 40 has sides 46 to prevent the workpieces from falling over the edges of the tray as they are released from the die 320 and slide into a basket. Roller guides or grooves 44 are further provided on the underside 42 of the tray 40 to maintain the tray 40 in a true position as it reciprocates back and forth, into and out of the separating die halves 321 and 322.

The flat top surface 32 of support members 30 provides a sliding surface for a slide 62 which is pivotally connected by pin 66 to tray arm 60 at end 64. As the end 64 reciprocates back and forth, slide 62 maintains constant contact with the top surface 32 of the member 30 and provides the additional support required for reciprocating tray 40.

Tray arm 60 is pinned to reciprocating tray 40 by pin 67 as shown in FIGS. 2 and 3. The opposite end 68 of the tray arm 60 is connected to link arm 80 by pin 70 such that tray arm 60 and link arm 80 are pivotally attached. The other end of link arm 80 is pivotally attached to actuating arm 100 at end 102 by pin 72.

Figure 4:
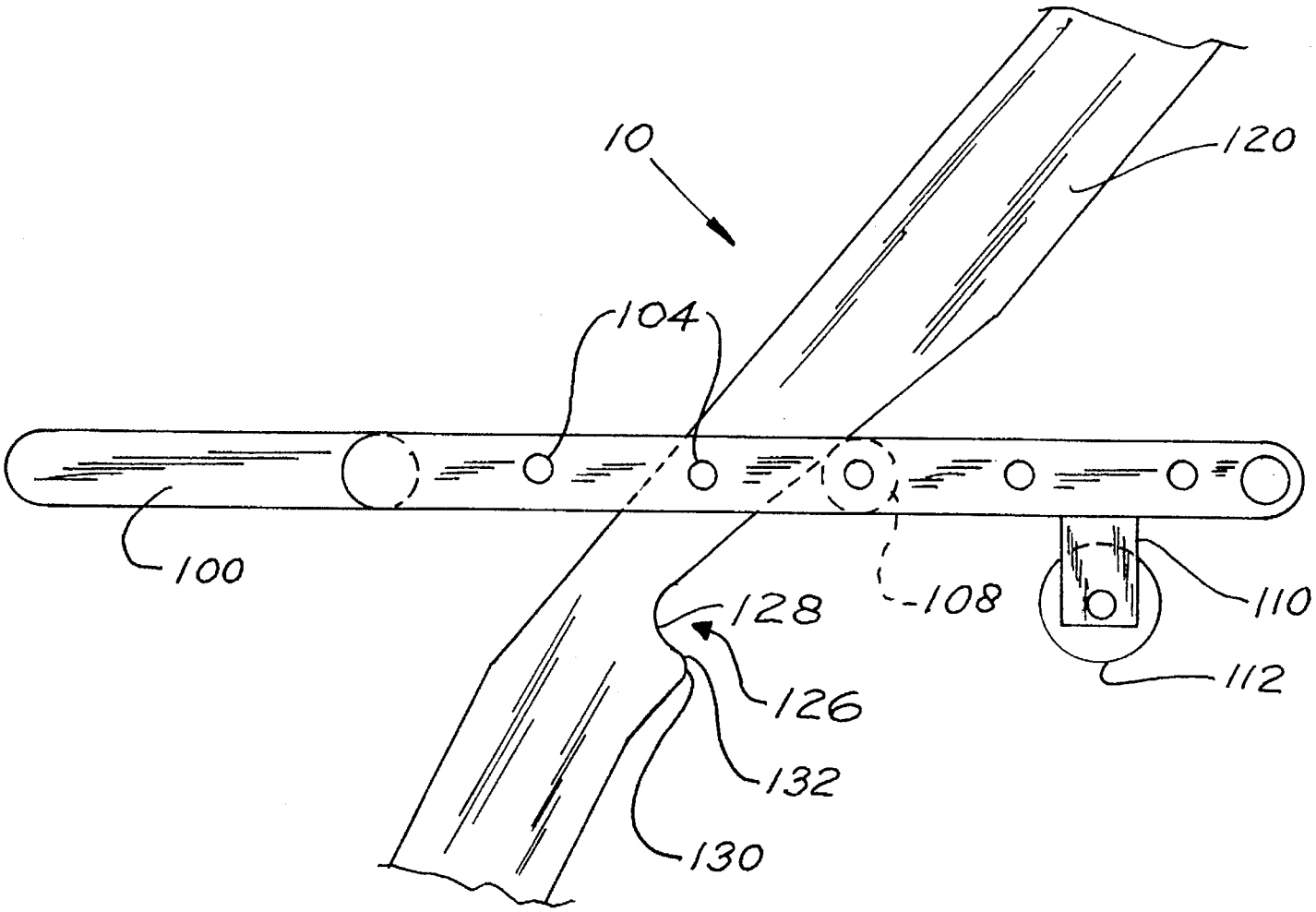
FIG. 4 is a side view of the actuating arm and attachment arm of the present invention.
Figure 5:
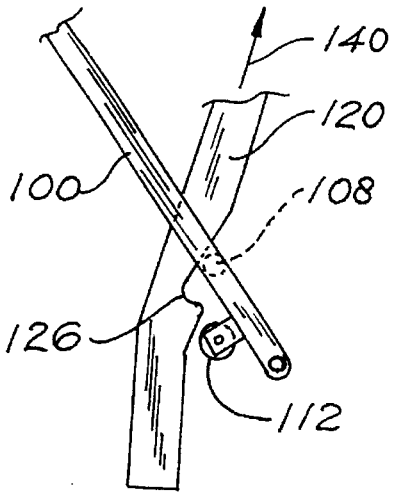
FIGS. 5 through 8 depict the relationship of the actuating arm and attachment arm through a stroke of the press to which the present invention is attached.
Figure 6:
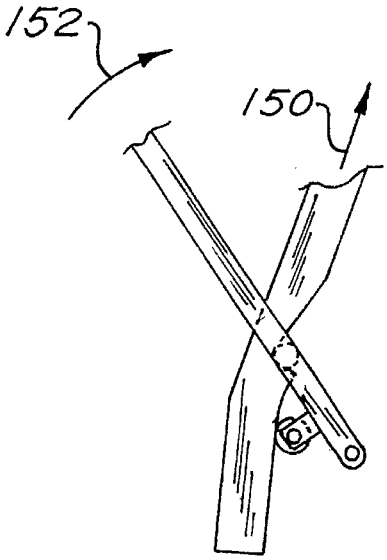

Actuating arm 100 has a plurality of openings or apertures 104 along its length. At its end 106, opposite end 102, actuating arm 100 is pivotally attached to frame 20 by pin 74. Referring to FIG. 4, a pickup roller 108 is rotatably connected to actuating arm 100 at one of the plurality of openings 104. Adjacent pickup roller 108, a release roller bracket 110 is attached to arm 100. A release roller 112 is rotatably mounted to bracket 110.

Attachment arm 120 has two ends 122 and 124. End 122 is pivotally connected to support frame 20 while end 124 is attached to the press ram. A pickup notch 126 is formed in the midsection of attachment arm 120. The geometry of the notch 126 is significant and can be best seen in FIG. 4. The notch geometry includes a pocket portion 128 and a lip portion 130. The radius of the pocket portion 128 is the same as the radius of the pickup roller 108. The lip portion 130 includes a curved edge 132. The curved edge 132 must be large enough so that the pickup roller 108 remains in pocket portion 128 while attachment arm 120 is drawn upward by the press ram. However, when attachment arm 120 is biased away from actuating arm 100 by the lever action of the release roller 112, as will be explained in detail below, the lip portion 130 is preferably constructed such that pickup roller 108 smoothly rolls over curved edge 132.

Looking at FIGS. 2 and 3 it may be seen that the attachment arm 120, the link arm 80, and the tray arm 60 are all attached to form an actuating linkage mechanism.

Figure 7:
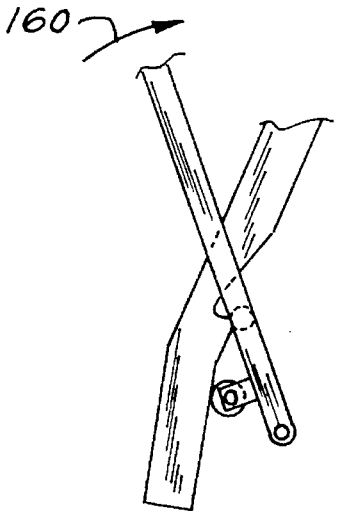
Figure 8:
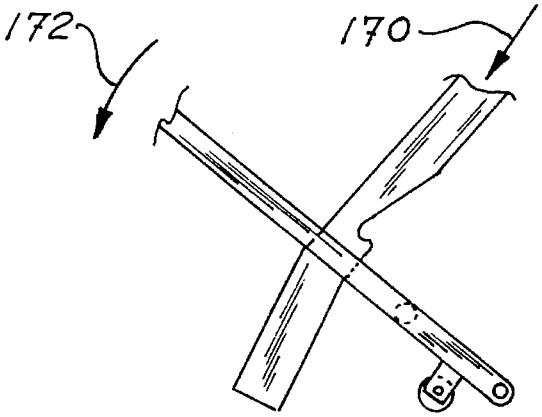

The press unloader for unloading presses 10 works as follows: The attachment arm 120 is attached to the press ram in a known manner, for example by means of the connector 220 shown in FIG. 1. Reference is now made to FIGS. 5 through 8 which show the relative movement of attachment arm 120 and actuating arm 100 during a stroke of the press. As the press ram rises, attachment arm 120 moves upward as shown by arrow 140 in FIG. 5 and the two die halves 321 and 322 of the press 300 begin to separate. The workpieces are held in place in the top die half 321. At this point, as again shown in FIG. 5, the pickup roller 108 is above the pickup notch 126 and the release roller 112 has not yet contacted attachment arm 120 below pickup notch 126. As the press ram 310 continues to rise, so does attachment arm 120 as shown by arrow 150 in FIG. 6. The attachment arm is drawn upward to the point where the pickup roller 108 engages pickup notch 126. Because the attachment arm is now contained by the engagement of the pickup roller 108 in the pickup notch 126, the attachment arm 100 rotates in the direction shown by arrow 152 until release roller 112 comes into contact with attachment arm 120. While the ram 310 further continues its upward stroke, actuating arm 100 continues to move as shown by arrow 152 in FIG. 6 into an upright position and consequently reciprocating tray 40 is drawn in between the gap formed by the separating press die halves 321 and 322 by tray arm 60. As the top die half 321 nears the top of the press ram stroke, the die release pins release the workpieces onto the reciprocating tray 40. When the press ram stroke is approximately 3 inches (7.62 cm) from top dead center, the pickup roller 108 is biased out of pickup notch 126 as shown in FIG. 7 by the lever action caused by the relative position of release roller 112 with respect to the position of actuating arm 100. The reciprocating tray 40, which is connected to actuating arm 100 via link arm 80 and tray arm 60 then retracts on its slide 62 and its rollers 38 out of the gap presented by the separated die halves 321 and 322. Because reciprocating tray 40 slides on rollers 38 and slide 62 which are mounted to support members 30 which are positioned on an incline as shown in FIGS. 2 and 3, the force of gravity returns reciprocating tray 40 to its fully retracted position. As the tray 40 retracts, actuating arm 100 moves in the direction shown by arrow 172 in FIG. 8. Thus, when the die halves 321 and 322 begin to close and the attachment arm 120 is retracted, as shown by arrow 170 in FIG. 8, the reciprocating tray 40 will not be caught between the closing die halves 321 and 322.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

What is claimed is:

1. An apparatus for unloading workpieces from a press having a ram mechanism, the apparatus comprising:

an attachment linkage extending substantially from a support structure to the ram mechanism and including an engagement structure;

an actuating linkage mechanism having a bearing surface engaged with a portion of the support structure, a substantially fixed connection to a workpiece receiving structure, a bearing structure capable of both engaging and disengaging the engagement structure, and a lever mechanism;

the lever mechanism being connected to the linkage mechanism and extending substantially from a portion of the linkage mechanism toward a portion of the attachment linkage;

the lever mechanism capable of contacting the attachment linkage.

2. The apparatus for unloading workpieces of claim 1 wherein the attachment linkage comprises:

a first bar member having an end attachable to the ram mechanism, and a second bar member pivotally attachable to the activating arm.

3. The apparatus for unloading workpieces of claim 1 wherein the actuating linkage mechanism comprises:

a first bar member adjustably attachable to the actuating arm, and a tray arm member adjustably attachable to the support frame member.

4. The apparatus for unloading workpieces of claim 1 wherein the lever mechanism is adjustably connectable to the attachment linkage.

5. A method for unloading workpieces from a press having a ram mechanism capable of moving in a predetermined manner using an apparatus including an attachment linkage extending substantially from a support structure to the ram mechanism and including an engagement structure; a linkage mechanism having a bearing surface engaged with a portion of the support structure, a substantially fixed connection to a workpiece receiving structure, a bearing structure capable of both engaging and disengaging the engagement structure, and a lever mechanism; the lever mechanism being connected to the linkage mechanism and extending substantially from a portion of the linkage mechanism to a portion of the attachment linkage, the method comprising the steps of:

moving the ram so that the engagement structure engages the bearing structure of the linkage mechanism so that the workpiece receiving structure is moved a predetermined distance, in a predetermined direction, into the press;

disengaging the bearing structure from the engagement structure with the lever mechanism after the workpiece receiving structure has moved the predetermined distance, in the predetermined direction into the press;

sliding the workpiece receiving structure out of the press on the bearing surface engaged with the portion of the support structure.

6. An apparatus for removing workpieces from a press, the press having a press ram, the apparatus comprising:

a support frame;

a reciprocating tray;

a tray arm having a first end, a second end, and a midsection;

a link arm having a first end, a second end, and a midsection;

an actuating arm having a first end, a second end, and a midsection; and an attachment arm having a first end, a second end, and a midsection;

the support frame having a pair of support frame members with each member having a top surface and an end;

each end of each of the support frame members having a tray roller rotatably mounted thereto;

each tray roller supporting the reciprocating tray;

the first end of the tray arm slidably engaged with the top surface of one of the support frame members, the second end of the tray arm pivotally attached to the first end of the link arm, the midsection of the tray arm pinably connected to the reciprocating tray;

the first end of the actuating arm pivotally connected to the second end of the link arm, the second end of the actuating arm pivotally connected to the support frame;

a pickup roller rotatably attached to the actuating arm near the midsection;

a release roller rotatably attached to the actuating arm near the midsection and adjacent the pickup roller;

the first end of the attachment arm pivotally connected to the support frame, the second end of the attachment arm connected to the press ram;

a pickup notch formed in the mid section of the attachment arm for receiving and releasing the pickup roller.

7. The apparatus for unloading workpieces of claim 6 wherein the midsection of the actuating arm includes a plurality of apertures through which the attachment arm can be pivotally attached to the actuating arm for adjusting the travel distance of the reciprocating tray.

8. The apparatus for unloading workpieces of claim 6 wherein the support frame member further includes a plurality of apertures for attaching the tray arm to the support frame for adjusting the angle of the reciprocating tray.

9. An apparatus for unloading workpieces from a press having a press ram, the apparatus comprising:

a nonhydraulic linkage assembly having a first end and a second end;

the first end attached to the press ram;

the second end adjustably attached to a slidable reciprocating tray;

the tray adjustably received within the press;

the reciprocating tray adjustable as to height, and adjustable as to the approach angle relative to the press ram.

* * * * *